United States Patent [19]

Föttinger et al.

[11] Patent Number: 4,709,490

[45] Date of Patent: Dec. 1, 1987

[54] INSOLE

[75] Inventors: Walter Föttinger, Weinheim; Kurt Jörder, Weinheim-Heiligkreuz, both of Fed. Rep. of Germany

[73] Assignee: Firma Carl Freudenberg, Weinheim/Bergstr., Fed. Rep. of Germany

[21] Appl. No.: 867,482

[22] Filed: May 27, 1986

[30] Foreign Application Priority Data

Jun. 5, 1985 [DE] Fed. Rep. of Germany ..... 3520093

[51] Int. Cl.[4] ..... A43B 13/38

[52] U.S. Cl. ..... 36/44; 36/43

[58] Field of Search ..... 36/44, 43, 71

[56] References Cited

U.S. PATENT DOCUMENTS 4,192,086 3/1980 Sichak ..... 36/44

4,461,099 7/1984 Bailly ..... 36/44

FOREIGN PATENT DOCUMENTS 0075499 3/1983 European Pat. Off. ..... 36/44

2562474 10/1985 France ..... 36/43

*Primary Examiner*—James K. Chi

*Attorney, Agent, or Firm*—Felfe & Lynch

[57] ABSTRACT

An insole has a capillarily-conductive layer of hydrophobic fibers superimposed on a moisture-storing layer of absorbent fibers with a moisture-permeable bond between the layers.

8 Claims, 1 Drawing Figure

INSOLE

BACKGROUND OF THE INVENTION

Figure 1:
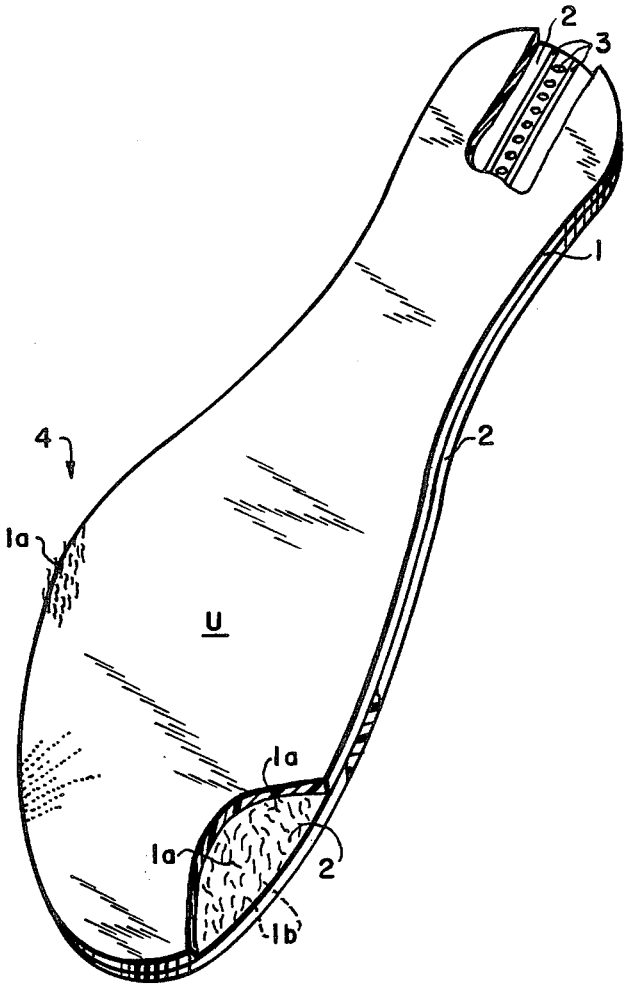

The invention relates to an insole and, more particularly, an insole having a capillarily-conductive layer of hydrophobic fibers superimposed on a moisture-storing layer of absorbent fibers.

A known insole has an intermediate absorbent layer overlaid with a top layer of cotton fabric and underlaid with a bottom layer of cork. The layers are sewn together in a way which also forms a seam about the insole. This requires individual manufacture and, thus, increases the manufacturing cost. Moreover, the cotton fabric has a moisture-storing absorbance too similar to that of the actual, intermediate absorbent layer. Absorbed moisture is, therefore, always felt on the exposed surface of the top, cotton-fabric layer, and this detracts considerably from the wearing comfort of the insole.

SUMMARY OF THE INVENTION

An object of the invention is, therefore, to provide an insole which can be manufactured at low cost and which always feels dry on its exposed, generally-upper surface, even after it has absorbed moisture.

In accordance with the invention, this and other objects are accomplished by an insole having a capillarily-conductive layer of hydrophobic fibers superimposed on a moisture-storing layer of absorbent fibers. For this, the hydrophobic fibers of the capillarily-conductive layer define therebetween pores that have capillary conductive action on water-based moisture of the types encountered by insoles. The pores extend through the capillarily-conductive layer from its exposed, generally-upper surface to its opposite surface superimposed on the moisture-storing layer.

Unlike the moisture-storing layer of absorbent fibers, the superimposed, capillarily-conductive layer of hydrophobic fibers which is generally on top of the insole in use has no moisture-storing function. Moisture settling on its exposed, generally-upper surface is, instead, quickly conducted capillarily to and then absorbed into the absorbent layer. For this, therefore, the superposing of the layers described and any bonding between the layers thereof must be moisture permeable. The result is that the upper surface of the insole always feels dry. Such an insole thus provides greatly-enhanced wearing comfort as compared to the known insole described above.

The capillarily-conductive layer of hydrophobic fibers preferably possesses inherent stability as, for example, a woven, knitted or bonded fabric of the hydrophobic fibers. Woven or knitted fabrics inherently provide this and, thus, make it possible to produce the layer entirely from any of a wide variety of hydrophobic fibers. A bonded, i.e. nonwoven, fabric, however, has to have its randomly-oriented fibers securely bonded to one another for such stability and, for low weight per unit area as also desired for insole use, this should be done by heat-sealing the fibers to one another. This limits the hydrophobic fibers to those which can be heat sealed. Alternatively, a separate bonding agent could be employed but, in many cases, this will result in loss of desired fabric properties such as the low weight already indicated or, especially, softness or good shape retention.

The capillarily-conductive layer may have fibers which protrude generally perpendicularly from its exposed, generally-upper surface to aid in draining moisture settling thereon through the layer. A surface structure of this type may be made by mechanically roughening or abrading the surface, for example.

The insole of the invention can be manufactured advantageously by die cutting or punching it out of a material of the two layers, preferably already bonded together, and produced in larger sheets. It can therefore be manufactured at low cost and in volume.

For bonding the superposed layers together, which is preferred, it has proved highly advantageous for some of the hydrophobic fibers of the capillarily-conductive layer to penetrate into the absorbent-fiber layer because this also aids effective conduction of moisture into the absorbent layer. This can be done by needling fibers of the hydrophobic-fiber layer into the absorbent-fiber layer.

The needling layer-bonding technique works especially well when the absorbent-fiber layer is a fabric, for example, a nonwoven fabric of fibers containing viscose. Merely needling the layers together then provides such a high-strength union of the layers that other, secondary, layer-bonding techniques are not needed.

In another embodiment, however, the layers are bonded to each other by discontinuous deposits of adhesive, for example, in a dot and/or continuous-strip pattern distributed uniformly over their entire area of superposed contact. Hot-melt adhesive is particularly preferred for this. It can also be disposed between the layers in the form of a grid or web having inherent stability and then activated for adhesive bonding by hot calendering. Contact cements, chemically crosslinkable adhesives, solvent-softened adhesives or dispersion adhesives may also be used, however. The discontinuities between the adhesive deposits provide the necessary moisture permeability to the bond between the layers.

If desired, any of the layer-bonding techniques described may be effected outside the textile mill producing the fiber layers. They may be carried out at a shoe factory, for example, to facilitate adapting the layer-bonding technique to the specific requirements of the shoemaking process for which the insole produced is intended.

A particular advantage offered by the insole of the invention is that its exposed, generally-upper surface of the layer of hydrophobic fibers always feels dry and warm, even after moisture is stored in the layer of absorbent fibers. The pores that penetrate the generally-top, hydrophobic-fiber layer and provide the capillary action do not clog, even after long-time use. This is important both for conducting moisture to the absorbent-fiber layer for absorption and releasing any absorbed moisture back by way of the pores to the exposed, generally-upper surface quickly, for example, overnight when the insole is exposed while the shoe with it is not being worn.

DESCRIPTION OF THE DRAWING AND PREFERRED EMBODIMENTS

A merely-illustrative embodiment of an insole according to the invention is shown in perspective, partly broken away and in section, in the accompanying drawing merely by way of example and will now be described in greater detail.

The insole has a top, capillarily-conductive layer 1 of hydrophobic fibers 1*a* superimposed on a moisture-storing layer 2 of absorbent fibers (not identified by reference character). The layers have a combined thickness in the range of from about 1.5 to about 5 mm and, more preferably, of from about 2.5 to about 3.5 mm and a weight of at least 200 g/m$^2$ and, more preferably, of from about 400 to about 1200 g/m$^2$. The moisture-storing layer 2 of absorbent fibers accounts for not less than about 60 and not more than about 95 weight percent of the total weight per square meter, and the capillarily-conductive layer 1 of hydrophobic fibers 1*a*, for not more than 40 and not less than 5 weight percent.

At least 50 weight percent of the moisture-storing layer 2 is absorbent fibers. The absorbent fibers may be of natural or synthetic origin. Wool, cotton and/or rayon staple, and fully-synthetic hollow or porous fibers are preferred. Good properties can also be obtained, however, with cellulose pulp and/or superabsorbent fibers such as, for example, rayon staple fibers grafted with carboxymethylcellulose.

The fibers of either layer may be loose but, preferably, form a woven, knitted or nonwoven fabric of the fibers. At least in the nonwoven fabric, the fibers can be additionally bonded to each other by a bonding agent, if desired. Odor-neutralizing substances, for example, bactericidal and/or fungicidal agents, as well as activated charcoal, may also be incorporated into either layer and, preferably, the moisture-storing layer in known ways.

All the fibers of the capillarily-conductive layer are hydrophobic. Fibers having optimal scuff resistance, particularly polyester fibers, are preferred. The exposed, generally-upper surface U of the capillarily-conductive layer 2 will then have a particularly dry and soft handle under most conditions. However, polypropylene, polyamide, polyacrylic, polyvinyl chloride and other hydrophobic fibers may also be used. The later-specified, above fibers are available at the lower cost than polyester fibers.

After the layers have been produced separately, preferably in large sheets, the capillarily-conductive layer is placed on top of the moisture-storing layer 2 and the layers are needled from the exposed, top surface U of the capillarily-conductive layer through the capillarily-conductive layer so that portions 1*b* of the hydrophobic fibers 1*a* of the capillarily-conductive layer penetrate into the moisture-storing layer 2 for bonding the layers together. This bond has such good strength that the sheets can be used directly as raw material for punching out individual insoles and that the insoles are then ready for use.

The insole of the invention has a water-absorption capacity of at least 100 weight percent and, preferably, of from about 150 to about 400 weight percent. Nevertheless, it will readily dry out overnight and is fully washable.

Generally as an alternative but, in the embodiment shown in the drawing, in addition to the needled, fiber-penetrating bond between the layers 1, 2, at least the heel portion of the insole shown also has discontinuous deposits of adhesive 3 between the layers 1, 2 for additionally bonding the layers together. The discontinuities between the adhesive deposits provide moisture permeability between the layers.

Some of the fibers 1*a* of the capillarily-conductive layer project generally perpendicularily from its exposed, generally-upper surface U as shown at 4. Known mechanical devices can cause this. The projecting fibers aid moisture conduction into and through the capillarily-conductive layer.

It will be appreciated that the instant specification and claims are set forth by way of illustration and not of limitation, and that various changes and modifications may be made without departing from the spirit and scope of the present invention.

What is claimed is:

1. A two layer insole including a moisture-storing layer and a capillarily-conductive layer, having a total thickness from about 1.5 to about 5 mm and a weight from about 200 g/m$^2$ to about 1200 g/m$^2$, said moisture-storing layer constituting not less than about 60 and not more than about 95 weight percent of the total weight per square meter, and comprising absorbent fibers, said capillarily-conductive layer consisting of hydrophobic fibers superimposed on the moisture-storing layer and providing an opposite, exposed surface, the hydrophobic fibers defining pores therebetween for capillarily-conducting moisture from the exposed surface of the capillarily-conductive layer to the moisture-storing layer; and means for bonding the two layers together moisture permeably, said bonding means comprising some of the hydrophobic fibers of the capillarily-conductive layer which penetrate into the moisture-storing layer.

2. The insole of claim 1, wherein the capillarily-conductive layer is one of a woven, knitted and nonwoven fabric of the hydrophobic fibers.

3. The insole of claim 1, wherein some of the hydrophobic fibers of the capillarily-conductive layer project generally perpendicularly from the exposed surface of the capillarily-conductive layer.

4. The insole of claim 2, wherein some of the hydrophobic fibers of the capillarily-conductive layer project generally perpendicularly from the exposed surface of the capillarily-conductive layer.

5. The insole of claim 1, wherein the bonding means comprises discontinuous deposits of adhesive between the layers.

6. The insole of claim 2, wherein the bonding means comprises discontinuous deposits of adhesive between the layers.

7. The insole of claim 3, wherein the bonding means comprises discontinuous deposits of adhesive between the layers.

8. The insole of claim 4, wherein the bonding means comprises discontinuous deposits of adhesive between the layers.

* * * * *